US006460459B1

(12) United States Patent
Mc Cahon et al.

(10) Patent No.: US 6,460,459 B1
(45) Date of Patent: Oct. 8, 2002

(54) METHOD AND SYSTEM UTILIZING A LASER FOR EXPLOSION OF AN ENCASED HIGH EXPLOSIVE

(75) Inventors: Stephen W. Mc Cahon, Tucson; Scott G. Martin; Robert W. Knox, both of Oro Valley; Andrew E. Paul, Tucson, all of AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/544,677

(22) Filed: Apr. 7, 2000

(51) Int. Cl.[7] ..... F42C 19/00
(52) U.S. Cl. ..... 102/201
(58) Field of Search ..... 102/201, 427

(56) References Cited

U.S. PATENT DOCUMENTS 3,812,783 A * 5/1974 Yang et al. ..... 102/201
4,917,014 A * 4/1990 Loughry et al. ..... 102/201
5,046,423 A * 9/1991 Paisley ..... 102/201
5,081,900 A * 1/1992 Buntzen et al.
5,099,761 A * 3/1992 Betts et al. ..... 102/201
H1214 H * 8/1993 Liva et al. ..... 102/201
5,478,028 A * 12/1995 Snyder ..... 244/3.11
6,014,922 A * 1/2000 Livingston
6,153,871 A * 11/2000 Livingston

* cited by examiner

*Primary Examiner*—Charles T. Jordan
*Assistant Examiner*—Lulit Semunegus
(74) *Attorney, Agent, or Firm*—Colin M. Raufer; Leonard A. Alkov; Glenn H. Lenzen, Jr.

(57) ABSTRACT

A method for exploding a high explosive material confined in a casing which includes the steps of generating a laser beam; directing the laser beam toward a location on a surface of the casing; and irradiating the surface location with the laser beam a sufficient length of time to explode the high explosive material.

19 Claims, 2 Drawing Sheets

METHOD AND SYSTEM UTILIZING A LASER FOR EXPLOSION OF AN ENCASED HIGH EXPLOSIVE

BACKGROUND OF THE INVENTION

The invention relates to a method to explode an encased high explosive (HE) material, and more particularly to a method for utilizing a laser to explode a metal encased HE material.

In the past there have been numerous attempts to use lasers to initiate HE materials in a variety of configurations. In order to appreciate the prior art attempts, it is necessary to provide some background information and definitions.

Types of explosions: There exist several ways in which HE material can "burn" that ultimately determines the magnitude of an explosion relative to the explosive potential of a given material. The most explosive event is referred to as a detonation, which indicates presence of a pressure shock wave within the HE which moves in the HE material at a speed faster than the speed of sound. In comparison, the next most explosive event is referred to as a deflagration in which the pressure shock wave associated with the burn moves in the HE material at a speed (the exact speed depending on the local pressure) which is at or below the speed of. This event may or may not be visibly distinguishable from a detonation event, depending on the burn rate of the HE material and the resulting pressure wave generated. Furthermore, a detonation typically leads to a total consumption of the HE material while a deflagration, because it is more readily quenched, may or may not consume all of the HE material. Whereas both a detonation and a deflagration can be initiated via an initial localized pressure wave, both events may also be initiated via thermal mechanisms in a very specific manner. The most common and probable thermal mechanism that leads to either detonation or a violent deflagration is a so-called slow cookoff. Slow cookoff describes a situation in which the encased HE material is heated in a slow manner causing the initial temperature to be raised in a relatively uniform fashion. Consequently, thermally induced chemical and/or structural (porosity and density) changes of the HE material take place throughout the entire volume which typically lead to a more sensitive HE material as compared to the original material. As the temperature continues to rise, gases released from the HE material increase the internal pressure of the container. Ultimately, a temperature and pressure threshold is reached near the center of the HE material that leads to an explosion (initially a deflagration that may or may not transition to detonation). In contrast, fast cookoff is a process by which the temperature of the encased HE material is raised rapidly causing only the outer perimeter of the HE material to be affected. Furthermore, the rapid rise in the temperature soon reaches an ignition (burn) temperature for the HE material causing an increase in the internal pressure. However, because the majority of the HE material has not changed in its chemistry and/or structure, it remains unchanged in terms of its ability to propagate a rapid burn. Consequently, the pressures associated with the burn are not significant enough to lead to the propagation of a self-sustained violent reaction prior to eruption of the HE casing. At the point when the casing breaks, the release of pressure typically quenches the intensity of the burn, resulting in an overall less violent explosive event.

Types of explosives: There exist a wide variety of HE materials which can be classified in several ways. Sensitive and insensitive explosives typically refer to the relative ease in which these materials may be initiated resulting in an explosive event. The specific term insensitive high explosives (IHEs) refers to a very special class of high explosives (e.g., TATB) that are very difficult to initiate, and are not the type of explosive with which the present invention is concerned. The relative sensitivity of explosives addressed in the context of warhead materials which the present invention is concerned with, only cover conventional secondary explosives and not primary explosive materials used in common igniter ordnance (e.g., lead azide). In this context, the secondary HE material is much less sensitive when compared to the detonator explosive, which requires a smaller thermal input or pressure pulse to initiate. In addition to the relative sensitivity, secondary HE materials are also categorized in terms of their formulation. Secondary HE material formulations can be described in terms of two broad categories: melt cast and pressed. Melt cast explosives are created by melting together the basic constituents of a formulation and pouring the resulting mixture into a warhead or confinement vessel. Melt cast explosives typically consist of TNT as one of the main constituents. The other broad category of secondary HE materials is so-called pressed HE material. Pressed HE materials are typically composed of a crystalline explosive material combined with a binder and compressed so large samples can be produced. In the absence of the binder, pressed HE materials will not hold their form and typically have an increased sensitivity relative to those with a binder present.

Previous accomplishments utilizing laser detonation for explosives: Prior attempts to initiate laser HE explosions can be categorized in two general forms: thermal and shock initiation. A laser initiated explosion of HE material resulting from a thermal mechanism has typically been performed on sensitive HE materials designed to respond to laser radiation. Less catastrophic events arising from thermal events on less sensitive HE material, such as fast cookoff, are the result of rapid overpressure of the confinement vessel. In this situation, almost all cases have lead to a quenched burn once the confinement vessel has ruptured (pressure vents) and the HE material has ceased to burn. In fact, this describes typical results of experiments to date attempting laser initiation of warheads. These experiments typically have used continuous wave (CW) laser operation with large field illumination simulating what has already been observed in fast cookoff testing using fuel fire as the heat source. On the other hand, direct detonation of relatively insensitive HE materials using lasers has been accomplished, but only under very specific conditions. In these cases, an extremely large pressure pulse was generated in the HE material via two general processes. The first process is to take advantage of the laser-HE material interaction in which HE material is ablated and a recoil force is generated in the HE material. In this situation, extremely large instantaneous irradiances (gigawatt/cm$^2$ peak irradiance using nanosecond type pulses) are required to reach the minimum detonation pressures (20–200 kbar).

Although this method does not particularly require total confinement, the interaction relies on the recoil forced from ablation which varies from material to material based on the details of the HE material properties (absorption, thermal conductivity, mass densities, etc.). From a laser weapons perspective, such pulses are unlikely due to issues related to propagation in the atmosphere and laser induced material damage mechanisms. Consequently, this approach has never been pursued from the perspective of a laser weapon designed to defend against threats containing HE warheads.

The other method to achieve laser initiation of a HE material is related to laser detonators. Laser detonation of a secondary HE material typically takes advantage of confinement of the HE material and strong absorption of metallic films. A common scenario involves a sapphire window with an aluminum film on one side. The aluminum film is in contact with the HE material and the sapphire window acts as a confining element that is transparent to the laser radiation. When the laser passes through the sapphire it is absorbed by the aluminum film, which immediately generates a plasma. Because of the confinement of the sapphire window, the laser generated plasma can only propagate into the HE material, initiating a pressure pulse of sufficient magnitude to lead to a detonation wave in the HE material. In this situation, confinement is critical to achieve to pressures required for a detonation.

Prior to the present invention, attempts to detonate a metal encased HE material by impinging a laser directly on the casing have not been successful.

SUMMARY OF THE INVENTION

It is an objective of the invention to provide a method for using a laser to initiate a confined high explosive resulting in an explosion, and in particular for laser initiation of an encased high explosive.

It is a further object of the invention to provide a system utilizing a laser as a defensive weapon to initiate a warhead comprising an encased high explosive.

The above and other objects of the invention are accomplished by the provision of a method for initiating a high explosive material enclosed in a casing, comprising: generating a high energy laser beam; directing the high energy laser beam toward a location on a surface of the casing; irradiating the surface location with the laser beam for a sufficient length of time to initiate the high explosive.

Preferably, the high energy laser produces a high energy pulsed laser beam, and more preferably a pulsed laser beam having a wavelength absorbed by the casing material and a pulse width on the order 1 millisecond. By firing such a laser at a rate of 35 Hz, we have found it possible to deliver enough energy to penetrate a steel plate in a controlled environment and to initiate an explosion of a steel encased high explosive material.

It is a further aspect of the invention to provide a defensive weapon for rendering inoperable an object carrying a warhead comprised of a metal encased explosive with the use of a laser in combination with an acquisition and pointing system for aiming the laser at the object containing the warhead.

Further objects, features and advantages of the invention will become apparent to the artisan from the following detailed description when considered in conjunction with the accompanying drawings.

DETAILED DESCRIPTION OF THE INVENTION

Lasers have been used to initiate explosives for various practical applications. The best-studied examples are Direct Optical Initiation (DOI) and Laser-Diode Ignition (LDI), representing two extremes of peak laser power. DOI relies on nanoseconds-long laser-driven shocks that rapidly lead to detonation of the HE material. LDI, on the other hand, is a slow thermal process using primarily continuous wave (CW) or long pulses to ignite the HE material much as accomplished by passing a low current through a bridge in contact with the HE material. The initiation processes in both of the above cases are well understood and have electrical analogs. The response of HE material to laser power between the two extremes represented by the above two cases has not been well characterized. In contrast, the inventors herein have shown the possibility of ignition of HE materials resulting in explosions using lasers similar to those useful for cutting through metals, that is, pulsed lasers producing pulses in the millisecond regime and energies of several Joules per pulse.

Figure 1A:
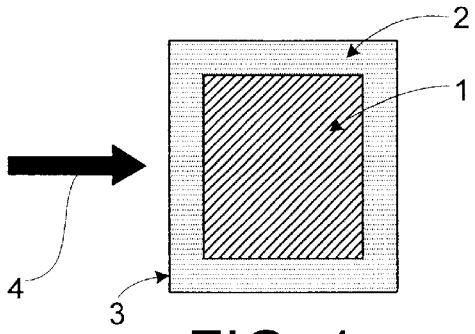
FIGS. 1*a*–1*d* are graphical depictions illustrating the use of a laser to initiate ignition of a steel encased explosive material in accordance with the method of the invention.
Figure 1B:
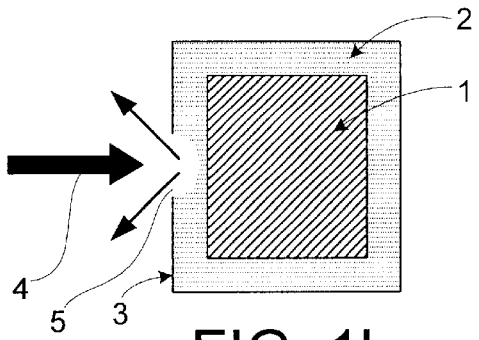
Figure 1C:
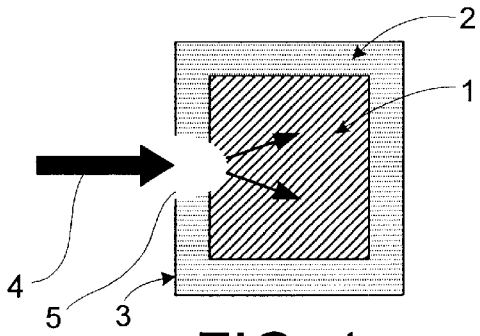
Figure 1D:
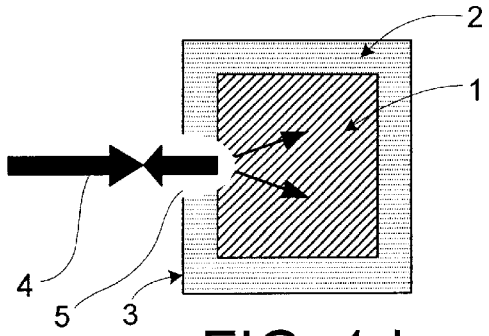

FIG. 1*a*–1*d* illustrate the steps in laser penetration of encased materials, leading to ignition and rapid disassembly (explosion) in accordance with the invention. In FIGS. 1*a*–1*d* a conventional high explosive 1 is confined in a metal casing 2, such as a steel casing, on all sides. In step one of the process illustrated in FIG. 1*a*, a laser beam, depicted by arrow 4, initially impinges on a surface 3 of the metal casing 2 resulting in surface heating of the casing 2. Step two, illustrated in FIG. 1*b*, shows the laser beam 4 penetrating the casing with an irradiance sufficient for penetration of the metal casing 2 by melting and/or vaporization of the material of the casing 2. In step three, illustrated in FIG. 1*c*, sustained irradiance of the laser beam 4 eventually causes penetration of the casing 2 whereby metal liquid and vapor are expelled toward the interior of the casing 2 and into the encased material 1. In step four of the process, illustrated at FIG. 1*d*, sustaining the laser beam 4 after penetrating through the steel casing 2 and into the HE material 1 causes ignition of the HE material 1, and as a result, gases and ignition flame are expelled out of a hole 5 created by the laser beam's 4 penetration of the casing 2, wherein some metal liquid and vapor may still persist but in very small quantities.

Experiments have been conducted in which a 1.06 micron wavelength pulsed laser yielded several explosions of steel encased HE material. In the experiments that were conducted, explosion was achieved both prior to the laser beam 4 penetrating the encased HE material 1 (FIG. 1*b*), as well promptly after the laser beam 4 penetrated the metal casing 2 (FIG. 1*c*), and, in one case, even after the laser beam 4 was turned off after penetration of the steel casing 2. The basic chemistry of a laser initiated explosion of a confined HE material requires a transition from an exothermic reaction to an endothermic reaction. That is, at some transition point, the rate of energy deposition by the laser must exceed the rate of energy lost by vapor gases and ignition flame expelled out of the hole created by the penetrating laser.

In the case of a penetrated casing, it is clear that the minimum condition is that the energy deposition rate exceed that of the energy loss rate arising from the pressure vent (hole) in the casing material. For example, in some of the experiments, the laser interacting with the encased HE material did not lead to explosion, indicating an energetic threshold for an explosion had not yet occurred. In all experiments where the interaction did lead to an explosion, the majority, if not all, of the HE material was consumed and the violence of the explosion was sufficient to cause rapid disassembly of the steel casing. These violent reactions are distinctly different from experiments using flood illumination of encased HE materials which have resulted in a fast cookoff effect wherein only a small fraction of the HE material is consumed as a result of the laser interaction. While the details of the ignition mechanism are not completely understood, these experiments clearly indicate an event that is both thermal in nature and leads to a violent explosion. The results of this event are distinctly different from the results of fast cookoff.

Three HE materials were selected for the experiments. The HE material was in the form of pellets, 1 inch long, 1 inch in diameter and with masses in the range of 20–25 grams. Table I below lists the HE materials used in the ignition test experiments.

TABLE I

HE materials used in ignition test series

| | Main HE Ingredient | Other ingredients | Preparation method |
|---|---|---|---|
| PBX 9404 | HMX (94% | Nitrocellulose (3%), CEF (3%), DPA (0.1%) | Hot pressed |
| PBX 9205 | RDX (92% | Polystyrene (6%), DOP (2%) | Pressed |
| Composition B | RDX (60% | TNT (40%) | Melt-cast |

Wherein:
CEF = Tris-□-chloroethylphosphate
DOP = dioctylphthalate
DPA = Diphenylamine
HMX = 1,3,5,7-tetranotro-1,3,5,7-tetraazacyclooctane
PBX = Plastic Bonded Explosive
RDX = 1-3-5-trinitro-1,3,5-triazacyclohexane
TNT = Trinitrotoluene The exact dimensions and masses of the HE materials are shown in Table II below for each test shot number.

TABLE II

HE samples used in the seven explosive ignition tests

| Shot # 1 | HE | Height (in) | Diameter (in) | Mass (g) | Density (g cm$^{-3}$) |
|---|---|---|---|---|---|
| 1 | PBX 9404 | 0.999 | 0.998 | 23.42 | 1.83 |
| 2 | PBX 9404 | 1.000 | 0.999 | 23.50 | 1.83 |
| 3 | PBX 9404 | 0.999 | 0.999 | 23.51 | 1.83 |
| 4 | PBX 9205 | 0.998 | 1.000 | 21.66 | 1.69 |
| 5 | PBX 9205 | 1.003 | 0.998 | 21.60 | 1.68 |
| 6 | Comp B | 0.999 | 1.001 | 22.31 | 1.73 |
| 7 | Comp B | 0.999 | 1.001 | 0.79 | 1.73 |

Wherein:
Comp B = Composition B
HE = High explosive
PBX = Plastic Bonded Explosive The tests were intended to judge potential violence of an explosion of a confined HE material. An explosive fixture encasing the HE material was made of 1018 mild carbon steel. The HE pellet was radially confine in a steel tube 1-inch in length, 1-inch inside diameter, 0.25 inches thick. Both ends of the tube were grooved to accommodate O-rings to seal decomposition gases and to aid the growth of the deflagation. End plates were made of 0.5 inch thick steel, with the front confining plate having a hole and countersink for laser access to the 0.1 inch steel cover plate over the explosive. Four grade 8 steel bolts and nuts ¼20's were used to assemble the fixture and were the weakest part of the confinement. The nuts were fully tightened in all of the shots accept for shot number 4 where the bolts were tightened only to 18 in-lb to examine the effects of weaker confinement.

The laser used to ignite the HE material was a Lumonics JK701H ND:YAG laser having a 1.06 micron wavelength output which was routed into a firing area using a 1 millimeter diameter optical fiber. Lenses were used to re-image the spot to the front face of the explosive test device. The laser delivered approximately 4.5 J/pulse at the position of the explosive test fixture and the laser spot size was approximately 1 millimeter in diameter. With optimized positioning of a steel plate, 300 or 400 laser pulses were required to open a hole through a bare 0.1 inch thick steel plate used as the front face of the test fixture. The temporal profile of the laser pulse is shown on FIG. 2.

Figure 2:
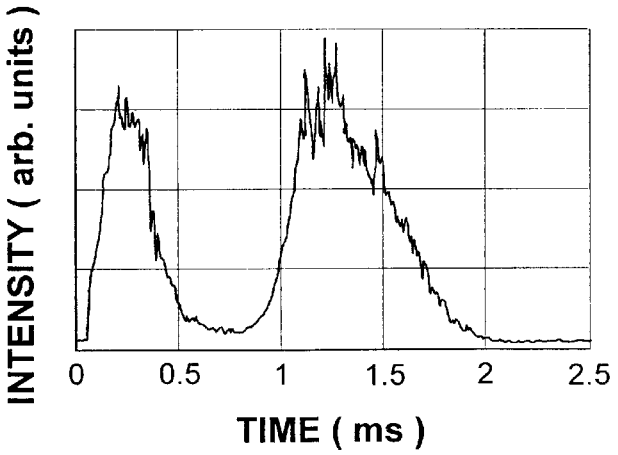
FIG. 2 is a diagram of a laser temporal pulse shape used in experiments for carrying out the method of the invention.

Although various pulse formats were selectable for the laser, the one shown in FIG. 2 was used for all ignition test shots which consisted of two closely spaced peaks spaced approximately 1 millisecond apart. The laser was fired at 35 Hz repetition rate for all initiation tests. For all tests, an arbitrary number of laser pulses for the complete duration of the laser exposure was selected between 1,000 and 5,000 pulses. Table III below summarizes the results of the tests.

TABLE III

Results of ignition tests

| Shot # | HE | # of laser pulses | Ignition | Violence |
|---|---|---|---|---|
| 1 | PBX 9404 | 2000 | Yes - 1.13s after Laser quit | Extensive damage to fixture |
| 2 | PBX 9404 | 1000 | No | Mass of recovered pellet: 23.35 g |
| 3 | PBX 9404 | 381 | Yes | Most violent of present test series |
| 4* | PBX 9205 | 311 | Ignition, No explosion | Quenched burn, 21.4 g pellet recovered |
| 5 | PBX 9205 | 232 | Yes | Tube distorted but intact, bolts sheared |
| 6 | Comp B | 320 | Yes | Damage included fragmentation of steel |
| 7 | Comp B | 320 | Yes | Damage included fragmentation of steel |

*The fixture of this shot was assembled with weaker confinement.
Comp B = Composition B
HE = High explosive
PBX = Plastic Bonded Explosive As observed from the damaged fixture, the PBX 9404 explosions were the most violent. Composition B was somewhat less violent, and PBX 9205 was the least violent. None of the explosions were detonations.

The most likely initiation scenario in the these experiments is the fast cookoff analog and in some ways these results are similar to expectation derived from such initiations. The explosive events observed were thermal events (not shock), confinement effects were observed, and the violence of all tests was less than expected from detonation. However, one possible difference between these results and fast cookoff is that conventional wisdom holds that fast cookoff is rarely violent, usually leading to pressure vents with little fragmentation of the confinement vessel. It is possible that the localized heating due to the laser leads to different violence than in fast cookoff tests where an entire device is heated in a fuel fire or flood laser illumination.

It is important to remember the difference between ignition and propagation of the ignition. For thermally induced explosions, ignition occurs when there is a localized volume where the exothermicity of the decomposition reactions of the HE material wins the race with thermal losses due to conduction and convection. Reactions thus become self-sustaining requiring no additional input of heat. This is a temperature criterion, and each HE material will need to reach its characteristic threshold temperature to achieve this thermal runaway. The consequence of the ignition (or violence or lethality) depends on another competition of processes: the propagation and acceleration of the combustion versus the loss of confinement. In general, HE materials do not burn rapidly at ambient pressures. Burning rates are highly dependent on pressure and the slope of the burning rate versus log-pressure curve (which is usually linear over a wide range of pressure) is a characteristic of each HE material. Therefore, some explosives may be more easily extinguished due to a loss of confinement. All HE materials exhibit departure from this well-behaved burning at either sufficiently high pressure or when the morphology allows convective burning (high surface area and connected porosity enhance such burning). Transition to such burning leads to more violent explosions and can precede a deflagration-to-detonation Transition (DDT). A detonation would be the most violent form of explosion. The foregoing experiments clearly demonstrate that laser ignition of encased explosive can lead to substantial violence (less than detonation), even for high density PBXs and melt-case HE materials.

Figure 3:
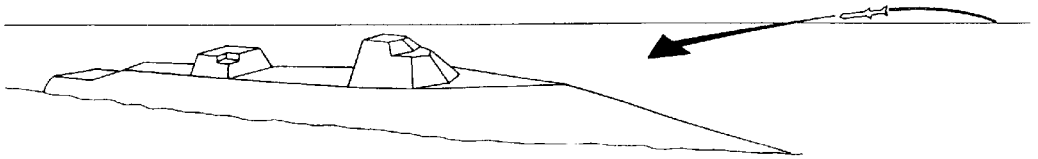
FIG. 3 illustrates use of a laser defense weapon onboard a ship for destroying a projectile containing a metal encased explosive.

With the demonstration of laser initiated explosion of a steel encased HE material, it is now possible to incorporate such a laser into a weapon for destroying objects containing warheads comprising of steel encased HE materials. By scaling up the laser and combining it with a suitable acquisition and laser pointing system, a self-defense weapon having enormous capability and flexibility is provided for protecting military assets. FIG. 3 illustrates a shipboard use of such a self-defense laser weapon for destroying a missile-carrying warhead by initiating the warhead through a thermal event as discussed above.

Figure 4:
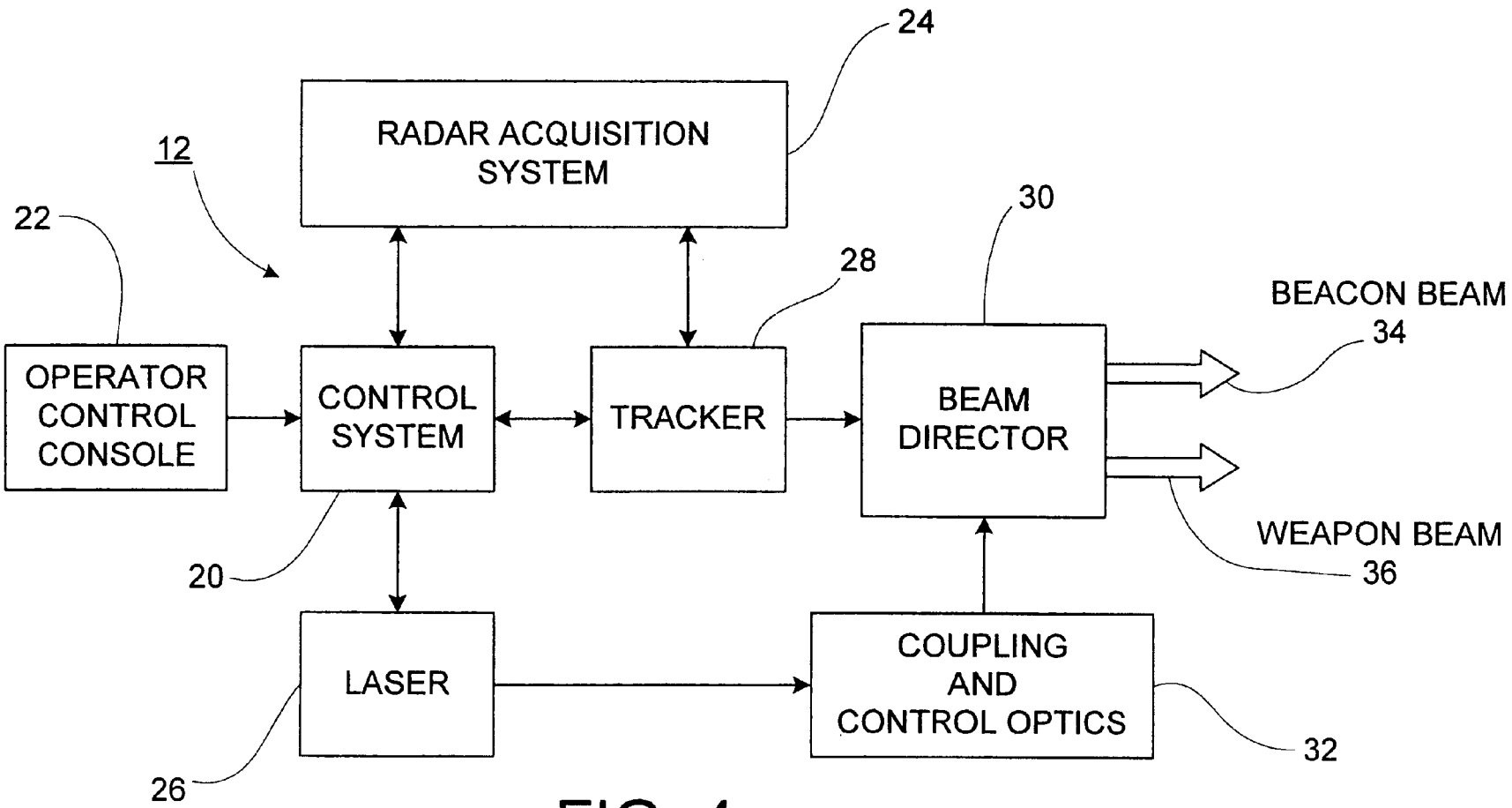
FIG. 4 is a block diagram of a defensive weapon system employing a laser in accordance with the invention.

FIG. 4 is a block diagram showing the major components of a laser weapon system 12. As shown in FIG. 4, a laser weapon control system 20 is coupled to an operator console 22, a radar acquisition system 24, high energy laser 26 and a tracking system 28. The output of laser 26 is coupled to a beam director 30 by way of coupling and control optics 32. The beam director produces a beacon beam 34 and a high energy weapon beam 36. The individual components of the laser weapon system 12 are well known and need not be described in detail. See, for example U.S. Pat. No. 5,198,607, incorporated herein by reference.

The acquisition system 24, is utilized to acquire the position of an object to be irradiated, such as a projectile. Information from the radar acquisition system 24 is fed to the tracking system 28 which is coupled to beam director 30 for controlling the beacon beam 34 and the high energy weapon beam 36. The beacon beam 34 is utilized for fine tracking of the projectile and precisely aiming the high energy weapon beam 36 at a location on the surface of the projectile where the warhead is typically located.

One additional problem facing laser weapon system 12 is the ability of the beacon beam 34 and particularly the high energy weapon beam 36 to propagate through the atmosphere. In order to carry out this aspect of the invention, the laser 26 preferably produces a pulsed output having a wavelength in a range of about 0.1 microns to about 10 microns, and most preferably approximately 1.1 microns. Additionally, it is preferred that the output of the laser 26 have a pulse width in the millisecond range, for example from about 0.1 microseconds to about 100 milliseconds. Preferably the laser pulses are generated at a rate of about 5 Hz to about 5 MHz.

What is claimed is:

1. A method for exploding a high explosive material confined in a casing, comprising the steps of:

generating a laser beam;

directing the laser beam toward a location on an outer surface of the casing, the outer surface of the casing being comprised of metal and not optically transparent to the laser beam; and irradiating the surface location with the laser beam a sufficient length of time to thermally initiate exploding of the high explosive material.

2. The method according to claim 1, wherein the generating step includes generating a pulsed laser beam.

3. The method according to claim 2, wherein each laser pulse has a temporal pulse width in a range from about 0.1 microseconds to about 100 ms.

4. The method according to claim 3, wherein the pulse width is more preferably in a range from about 1 microsecond to about 10 ms.

5. The method according to claim 2, wherein the frequency of the pulses is in a range from about 5 Hz to about 5 MHz.

6. The method according to claim 5, wherein the frequency of the pulses is more preferably in a range from about 50 Hz to about 500 KHz.

7. The method according to claim 2, wherein the laser beam is comprised of light having a wavelength in a range from about 0.1 microns to about 10 microns.

8. The method according to claim 7, wherein the wavelength is more preferably in a range from about 1.0 micron to about 1.1 microns.

9. The method according to claim 1, wherein the encased high explosive comprises a warhead of a moving projectile, and the method further comprises acquiring and tracking the projectile, and wherein the directing step includes directing the laser beam at the projectile based on information obtained from the acquiring and tracking step.

10. A laser system, comprising:

a laser control system;

a laser for generating a laser beam under control of the laser control system;

an acquisition and tracking system under control of the laser control system for acquiring and tracking an encased high explosive; and a system for directing the laser to a location on an outer surface of the encased high explosive based on information received from the acquisition and tracking system and for maintaining the laser directed to the location on the surface for a sufficient time to thermally initiate an explosion of the high explosive, the outer surface of the encased high explosive being comprised of metal and not optically transparent to the laser beam.

11. The system according to claim 10, wherein the laser comprises a pulsed laser beam.

12. The system according to claim 11, wherein each laser pulse has a pulse width in a range from 0.1 microseconds to about 100 ms.

13. The system according to claim 12, wherein the pulse width is more preferably in a range from about 1 microsecond to about 10 ms.

14. The system according to claim 11, wherein the frequency of the pulses is in a range from about 5 Hz to about 5 MHz.

15. The system according to claim 14, wherein the frequency of the pulses is more preferably in a range from about 50 Hz to about 500 KHz.

16. The system according to claim 11, wherein the laser beam is comprised of light having a wavelength in a range from about 0.1 microns to about 10 microns.

17. The system according to claim 16, wherein the wavelength is more preferably in a range from about 1.0 microns to about 1.1 microns.

18. The system according to claim 10, wherein the encased high explosive is a warhead.

19. The system according to claim 10, wherein the encased high explosive is a stationary explosive device.

* * * * *